United States Patent [19]

Clauss

[11] Patent Number: 4,770,666

[45] Date of Patent: Sep. 13, 1988

[54] LAUNDRY COMPOSITION CONTAINING PEROXYACID BLEACH AND SOIL RELEASE AGENT

[75] Inventor: Allen D. Clauss, Cincinnati, Ohio

[73] Assignee: The Procter & Gamble Company, Cincinnati, Ohio

[21] Appl. No.: 941,019

[22] Filed: Dec. 12, 1986

[51] Int. Cl.[4] ..... C11D 3/22; C11D 3/395; C11D 9/44; C11D 17/04

[52] U.S. Cl. ..... 8/111; 8/137; 252/91; 252/92; 252/95; 252/174.17; 252/174.21

[58] Field of Search ..... 427/393.4; 252/91, 92, 252/95, 174.17, 174.23, 174.21; 8/111, 137

[56] References Cited

U.S. PATENT DOCUMENTS

| | | | |
|---|---|---|---|
| 3,782,898 | 1/1974 | Mandell | 8/137 |
| 3,893,929 | 7/1975 | Basadur | 252/8.6 |
| 3,962,152 | 6/1976 | Nicol | 252/551 |
| 4,000,093 | 12/1976 | Nicol et al. | 252/529 |
| 4,108,600 | 8/1978 | Wong | 8/137 |
| 4,116,885 | 9/1978 | Derstadt et al. | 252/532 |
| 4,132,680 | 1/1979 | Nicol | 252/547 |
| 4,136,038 | 1/1979 | Pracht | 252/8.8 |
| 4,210,417 | 7/1980 | McClain | 8/137 |
| 4,214,997 | 7/1980 | Morris | 252/8.8 |
| 4,372,882 | 2/1983 | Koster | 252/529 |
| 4,374,035 | 2/1983 | Bossu | 252/91 |
| 4,391,724 | 7/1983 | Bacon | 252/90 |
| 4,441,881 | 4/1984 | Ruppert et al. | 8/137 |
| 4,483,778 | 11/1984 | Thompson | 252/94 |
| 4,486,327 | 12/1984 | Murphy | 252/94 |
| 4,532,063 | 7/1985 | Gueldenzopf | 252/90 |
| 4,539,130 | 9/1985 | Thompson | 252/94 |
| 4,564,463 | 1/1986 | Secemski et al. | 252/174.17 |
| 4,606,838 | 8/1986 | Burns | 252/94 |
| 4,634,551 | 1/1987 | Burns | 252/102 |
| 4,654,159 | 3/1987 | Bush | 252/95 |

*Primary Examiner*—Dennis Albrecht

*Attorney, Agent, or Firm*—Leonard Williamson; Richard C. Witte

[57] ABSTRACT

The present invention relates to laundry cleaning compositions and methods comprising a peroxyacid bleach and a soil release agent.

9 Claims, No Drawings

LAUNDRY COMPOSITION CONTAINING PEROXYACID BLEACH AND SOIL RELEASE AGENT

FIELD OF THE INVENTION

This invention relates to laundry compositions and methods comprising bleach and soil release agents.

BACKGROUND OF THE INVENTION

The use of soil release agents in laundry products per se is known in the art.

Soil release agents can be mixed with other laundering components. Examples of laundry detergent compositions containing cellulose ether soil release agents are disclosed in U.S. Pat. Nos. 4,000,093, C. H. Nicol and M. E. Burns, issued Dec. 28, 1976; 4,100,094, M. E. Burns, issued July 11, 1978; and 4,564,463, Secemski et al., issued Jan. 14, 1986. Examples of laundry presoak compositions and rinse additive compositions containing cellulose ether soil release agents are disclosed in U.S. Pat. No. 4,136,038, H. J. Pracht and M. E., Burns, issued Jan. 23, 1979. Examples of laundry detergent compositions containing terphthalate ester/ethylene oxide copolymers are disclosed in U.S. Pat. Nos. 4,132,680, C. H. Nicol, issued Jan. 2, 1979; 4,116,885, Derstadt et al., issued Sept. 26, 1978; and 4,411,831, Robinson et al., issued Oct. 25, 1983.

U.S. Pat. No. 4,132,680, supra, discloses unspecified bleaches as optional adjuncts to a detergent formulation containing a polyester soil release agent, and U.S. Pat. No. 4,210,417, McClain, issued July 1, 1980, discloses that a soil release agent may be incorporated into an unspecified liquid or unspecified dry bleach, U.S. Pat. No. 4,174,305, M. E. Burns, issued Nov. 13, 1979, discloses that perborate bleaches can be incorporated as dry admixes into detergent compositions containing cellulose ether soil release agents. U.S. Pat. No. 4,116,885, supra, discloses that bleaching agents can be incorporated into detergent formulations containing polyester soil release agents, specific examples given were chlorinated trisodium phosphate, and sodium and potassium salts of dichloroisocyanuric acid.

In none of the above disclosures was there an indication of superior or synergistic performance benefits in using any type of bleach in combination with a soil release agent.

Organic peroxyacid bleaches are known; but it is believed that heretofore they have not been known to be used in combination with soil release agents.

OBJECTS OF THE INVENTION

It is an object of the present invention to provide an improved laundry cleaning product which provides superior bleaching and cleaning of hydrophobic soils on synthetic fabrics and synthetic natural blend fabrics by use of a combination of peroxyacid bleaches and a soil release agent.

It is a further object of the present invention to provide laundry cleaning formulations which employ a peroxyacid bleach and a soil release agent to achieve performance beyond that possible with a comparable amount of either the peroxyacid or the soil release agent alone.

It is yet another object of this invention to provide a more cost-effective peroxyacid bleach-containing laundry product in which part of the expensive peroxyacid bleach is replaced by a less costly soil release agent and yet providing a product having equal or superior overall bleaching/cleaning performance to one with higher levels of bleach.

These and other objects of this invention will become apparent in the light of the following disclosure.

SUMMARY OF THE INVENTION

The present invention relates to laundry cleaning compositions and methods comprising a peroxyacid bleach and a soil release agent.

DETAILED DESCRIPTION OF THE INVENTION

The present invention provides an unexpectedly superior laundry cleaning composition comprising effective amounts of a peroxyacid bleach and a soil release agent. The peroxyacid and the soil release agent are preferably present at a ratio of weight of available oxygen to weight of soil release agent of from about 10:1 to about 1:10, more preferably from about 5:1 to about 1:5, and presently most preferably from about 2:1 to about 1:2. The present invention can be incorporated into a fully formulated, stand along product, or it can be formulated as an additive to be used in combination with a laundry detergent. It is preferably a dry composition, but can be in whole or in part a liquid or paste.

The peroxyacid can be a performed peroxyacid or it can be a combination of an inorganic persalt (e.g., sodium perborate) and an organic peroxyacid percursor which is converted to a peroxyacid when the combination of persalt and presursor is dissolved in water. The organic peroxyacid precursors are often referred to in the art as bleach activators.

Examples of suitable organic peroxyacids are disclosed in U.S. Pat. No. 4,374,035, F. P. Bossu, issued Feb. 15, 1983. Examples of compositions suitable for laundry bleaching which contain preferred activated perborate bleaches are disclosed in U.S. Pat. No. 4,412,934, Chung and Spadini, issued Nov. 1, 1983.

The preferred organic peroxyacid is selected from the following:

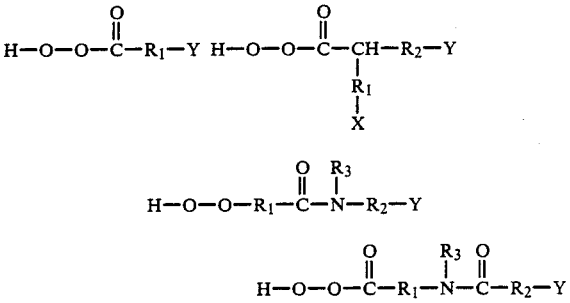

wherein $R_1$ and $R_2$ are alkylene groups containing from 1 to about 20 carbon atoms or phenylene groups, $R_3$ is hydrogen or an alkyl, aryl, or alkaryl group containing from about 1 to about 10 carbon atoms, and X and Y are hydrogen, halogen, alkyl, aryl, or any group which provides an anionic moiety in aqueous solution. Such X and Y groups can include, for example,

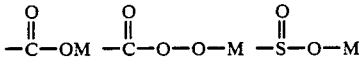

where M is hydrogen or a water-soluble salt-forming cation. Mixtures of peroxyacids can be used.

Specific examples of preferred peroxyacids for this ivention includ diperoxydodecanedioic acid (DPDA), nonylamide of peroxysuccinic acid (NAPSA), decyldiperoxysuccinic acid (DDPSA). For the purpose of this invention, the peroxyacid is preferably incorporated into a soluble granule according to the method described in U.S. Pat. No. 4,374,035, supra, incorporated herein by reference. The peroxyacid bleach is used at a level which provides an amount of available oxygen (AvO) from about 0.10% to about 10%, preferably from about 0.5% to about 5%, and most preferably from about 1% to about 4%. A preferred bleach granule comprises 1% to 50% of an exotherm control agent (e.g., boric acid); 1% to 25% of a peroxyacid compatible surfactant (e.g., $C_{13}$LAS); 0.1% to 10% of one or more chelant stabilizers (e.g., sodium pyrophosphates); and 10% to 50% of a water-soluble processing salt (e.g., $Na_2SO_4$).

Effective amounts of peroxyacid bleach per unit dose of the composition of this invention used in typical laundry liquor, e.g., containing 64 liters of 16°-60° C. water, provide from about 1 ppm to about 150 ppm of available oxygen (AvO), more preferably from about 5 ppm to about 50 ppm. The laundry liquor should also have a pH of from 7 to 10, preferably 7.5 to 9, for effective peroxyacid bleaching. See Col. 6, lines 1-10, of U.S. Pat. No. 4,374,035, supra, incorporated herein by reference.

Alternatively, the composition may contain a suitable organic precursor which generates one of the above peroxyacids when reacted with alkaline hydrogen peroxide in aqueous solution. The source of hydrogen peroxide can be any inorganic peroxygen compound which dissolves in aqueous solution to generate hydrogen peroxide, e.g., sodium perborate (monohydrate and tetrahydrate) and sodium percarbonate.

These compositions comprise:

(a) a peroxygen bleaching compound capable of yielding hydrogen peroxide in an aqueous solution; and (b) a bleach activator having the general formula:

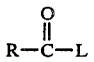

wherein R is an alkyl group containing from about 5 to about 18 carbon atoms wherein the longest linear alkyl chain extending from the including the carbonyl carbon contains from about 6 to about 10 carbon atoms and L is a leaving group, the conjugate acid of which has a $pK_a$ in the range of from about 6 to about 13.

Preferred compositions comprise an effective amount of soil release agent and peroxyacid bleach precursor and peroxygen compound to work in the wash solution. The peroxygen compound to soil release agent ratios are preferably 30:1 to 1:10; 15:1 to 1:5; and 3:1 to 1:2 on an AvO weight to soil release agent weight basis.

Any compatible soil release agent can be used in the present invention. For example, two general classes of nonionic water-soluble or water-dispersible polymers, cellulose ethers, and terephthalate ester/ethylene oxide copolymers are known to provide soil release benefits. While not being bound to any theory, it is believed that they do this by adsorbing onto fabrics, particularly synthetic fabrics such as polyester, such that stains, particularly greasy stains, subsequently transferred to the fabric are more easily removed in the next wash cycle.

The preferred soil release agent is selected from the following:

A. alkyl and hydrooxyalkyl ethers of cellulose containing from one to four carbon atoms in the alkyl or hydroxyalkyl moiety and having a molar degree of substitution of about 1.5 to about 2.7 and a number average molecular weight of about 2,000 to 100,000;

B. polymers comprising ethylene terephthalate and polyethylen oxide terephthalate at mole ratio from about 1:10 to 10:1, said polyethylene oxide terephthalate containing polyethylene oxide units with a number average molecular weight from about 500 to about 10,000, and said soil release agent having a number average molecular weight of about 1,000 to 100,000;

C. polymers comprising propylene terephtalate and polyethylene oxide terephthalate at a mole ratio from about 1:10 to about 10:1, said polyethylene oxide terephthalate containing polyethylene oxide units with a number average molecular weight from about 500 to about 10,000, and said soil release agent having a number average molecular weight of about 1,000 to 100,000;

D. polymers comprising ethylene terephthalate and/or propylene terephthalate in any ratio and polyethylene oxide and/or polypropylene oxide in ay ratio such that the mole ratio of ethylene terephthalate plus propylene terephthalate to polyethylene oxide plus propylene oxide is from about 1:10 to about 10:1, said polyethylene oxide units and said polypropylene oxide units each having a number average molecular weight from about 250 to about 10,000, and said soil release agent having a number average molecular weight of about 1,000 to about 100,000.

Any combination of the above soil release agents can be used.

It is an essential aspect of the present invention that the soil release agent be formulated and delivered in a manner that provides adsorption of this active to hydrophobic synthetic fabrics during the laundry process. Ideally the polymer is delivered in such a way and at levels which provide essentially the maximum soil release effect after a single wash-rinse-dry cycle. That is, essentially the full soil release advantage can be observed in the second washing of any particular garment.

It is intended that the scope of the present invention encompasses products and laundering methods in which the bleach component is released entirely in the wash and the soil release cycle, in the rinse cycle, or in the drying cycle, including partial delivery of the soil release agent in each of the different cycles.

Wash Cycle Delivery

When most or all of the soil release agent is delivered in the wash cycle, the efficiency of deposition on fabric and consequent soil release performance is dependent on the selection of soil release agent, detergent builder and surfactant actives. U.S. Pat. No. 4,000,093, supra, incorporated herein by reference, discloses cellulose-based soil release agents suitable for use in combination with detergent compositions. The preferred surfactants are the $C_{10}$-$C_{13}$ alkyl sulfate surfactants which are substantially free from interfering amounts of longer-chain length alkyl sulfates. U.S. Pat. No. 4,116,885, supra, incorporated herein by reference, discloses polyester/-polyether soil release agents used with only limited amounts of incompatible anionic surfactants.

In a different approach, U.S. Pat. No. 4,020,015, G. Bevan, issued Apr. 26, 1977, incorporated herein by reference, teaches that a variety of soil release agents show enhanced performance in dry granular detergents when the soil release agent is incorporated as a separate granular extrudate consisting of the soil release agent and a extrudable organic carrier. The latter approach has been found to be useful for formulating a soil release agent for the current invention. For example methylcelluose soil release agents such as those sold by Dow Chemical Co. under the trade name Methocel ® can be blended in a 1:1 ratio with polyethylene glycol (e.g., Carbowax PEG 3350) and the resultant blend extruded on a radial extruder and ground to the desired particle size. The resultant granular extrudates are rapidly soluble and provide excellent soil release performance when delivered to the wash cycle with a variety of different detergent formulations.

Soil Release Agent Coated Substrate

In the contact of the present invention, it was discovered that a new method of delivery of the soil release agent results in significant performance improvements. The new preferred method comprises coating the soil release agent onto a porous water-insoluble substrate material containing a pouched detergent and/or bleaching composition. In practice, the soil release agent can be coated onto the inside, or the outside of the pouch substrate, or it can be impregnated throughout the substrate void spaces, or it can be cast as a separate independent film and attached to the substrate pouch. In a preferred embodiment, a spun-bonded polyester nonwoven substrate such as DuPont Reemay 2420 is coated with a methylcellulose soil release agent such as Dow methocel A-15LV by immersing the substrate in an aqueous solution containing about 8% of the methylcellulose and about 3% of propyleneglycol plasticizer. The substrate is then run through nip rollers to remove the excess coating solution and dried at room temperature. The resultant coated substrate material is particularly suitable for making pouched detergent, bleach, or combination detergent/ bleach products which provide enhanced wash cycle cleaning and soil release performance.

Rinse Cycle Delivery

Enhanced soil release performance can be achieved for a variety of soil release agents by delivering them into the rinse cycle instead of the wash cycle. In particular, polyester/polyether soil release agents which are highly sensitive to interference by anionic surfactants in the wash can be used much more effectively with anionic detergents by rinse cycle delivery. Examples of suitable soil release agents for use in the rinse cycle in the context of the present invention include ethyleneterephthalate/ethyleneoxide copolymers sold by DuPont under the Zelcon trade name and by ICI under the Milease trade name. These materials can be delivered to the rinse cycle as aqueous dispersions or as rapidly dispersing granules or powders. An example of the latter form can be made by taking a suitable Zelcon material in the pure solid form, heating it to its softening point, and blending it with an equal mass of urea such that the urea and polymer are uniformly distrubuted. The resultant mass is cooled to a hard solid and ground to the desired granule size. The resultant granules disperse rapidly in a cold water rinse solution and provide excellent soil release performance.

In cases where it is particularly desirable to add the soil release agent in the rinse cycle, the polymer as an aqueous slurry or incorporated into granules as described can be manually added to the rinse cycle following a wash cycle in which one of the preferred peroxyacid bleaches is used. Preferably, however, the soil release agent component is incorporated into a single product also containing the peroxyacid bleach in such a way that the bleach is released in the wash cycle and the soil release agent is released in the rinse cycle of an automatic washing machine. There are several laundry product designs which can be used to effect such a sequential release delivery of actives. For example, U.S. Pat. No. 4,108,600, Wong, issued Aug. 22, 1978, incorporated herein by reference, describes fabric conditioning articles which release an electrolyte or pH control agent in the wash, the effect of which is to render insoluble in the wash a coating agent surrounding and protecting the active (i.e., soil release agent of the present invention) to be delivered in the rinse cycle. In a preferred embodiment the article consists of a porous outer pouch of spunbonded polyester which contains sodium borate and an inner nonporous film pouch of a polyvinyl alcohol which is rendered insoluble by the sodium borate in the wash solution and contains within it soil release agent to be delivered in the rinse cycle. For the purpose of the present invention, the article is made to contain peroxyacid bleach and optionally detergent in addition to sodium borate in the outer pouch, and soil release agent granules in the inner pouch. A product made in such a way releases the peroxyacid and detergent components at the beginning of the wash cycle and releases the soil release agent component in the rinse cycle.

Other patents, which described potentially useful product designs for automatic release of actives in the rinse cycle include: Canadian Pat. No. 1,133,712, Bristol-Myers Co., issued Oct. 19, 1982; U.S. Pat. Nos. 4,304,562, Bolan et al., issued Dec. 8, 1981; and 4,588,080, Ginn et al., issued May 13, 1986; said patents incorporated herein by reference.

Optionals

If the present invention is used in combination with a pouch, a bag, or the like, preferred pouch substrates are set out in the examples. Suitable substrates are also taught in U.S. Pat. Nos. 4,113,630, Hagner et al., issued Sept. 12, 1978, and 4,108,600, supra, and U.S. Ser. Nos. 675,804, filed Nov. 28, 1984; and 748,654, filed June 25, 1985, all incorporated herein by reference in their entirety. It is advantageous to include a substrate which contains or supports the active ingredients in a premeasured, single use amount and releases them at the desired point in the wash and/or rinse cycle. The substrate may also be used to separate or compartmentalize incompatible ingredients until they are released into the wash solution. As described above, a specially designed substrate may be particularly useful to effect a sequenced delivery in which the detergent and bleach ingredients are released in the wash cycle and the soil release agent is released in the late wash and/or rinse cycle. The substrate can take almost any physical form including pouches, sheets, webs, sponges, cups, etc. It may consist of nondissolving, partially dissolving or fully dissolving material, or combinations thereof. An example of a particularly useful substrate for the present invention is a two-ply multipouched laminated article disclosed in allowed U.S. application Ser. No. 675,804, W. T. Bedenk and K. L. Harden, filed Nov. 28, 1984, incorporated herein by reference in its entirety.

The present invention is preferably used as part of a fully formulated stand-alone detergent product wherein appropriate detergent components are present and released along with the peroxyacid bleach and soil release agent. Useful detergent compositions for use with this invention can include essentially any typical laundry detergent containing one or more types of organic surfactant along with detergency adjunct materials. The organic surfactant is selected from the group consisting of anionic, nonionic, ampholytic and zwitterionic surfactants, and mixtures thereof. U.S. Pat. No. 3,664,961, Norris, issued May 23, 1972, incorporated herein by reference, describes at Col. 1, line 68, to Col. 9, line 3, suitable surfactants useful herein. The anionic and nonionic surfactants are preferred. Nonlimiting examples of adjunct materials which can be used in the detergent composition include soil suspending agents, perfumes, optical bleaches, processing aids, alkalinity sources and enzymes. Nonlimiting examples of powdered detergent materials suitable for use with the present invention are disclosed in U.S. Pat. No. 4,404,128, B. J. Anderson, issued Sept. 13, 1983, incorporated herein by reference.

Fabric softeners can also be used in combination with the components of the present invention. A preferred softener is a particle formulated to survive (i.e., not dissolve in) the wash and rinse cycle, and melt and become distributed evenly on the fabric in the dryer cycle. The softener particle composition wash water survival should be at least 25%, preferably at least 40% by weight. Numerous examples of softener/antistat compositions which function in this manner are taught in the literature, e.g., U.S. Pat. Nos. 4,113,630, Hagner et al., issued Sept. 12, 1978, and 4,108,600, supra, which are incorporated herein by reference.

A preferred fabric softener (core) particle has the following formula:

| Ingredient | Wt. % |
|---|---|
| Ditallowdimethylammonium methylsulfate (DTDMAMS) | 42.4 |
| Sorbitan monostearate | 21.3 |
| Cetyl alcohol | 21.3 |
| Bentonite clay | 12.0 |
| Perfume | 3.0 |
| Total | 100.0 |

The softener core particles are coated with stearyl alcohol in an amount such that the stearyl alcohol comprises 11% of the total particle composition (i.e., core plus coating).

The coated particles can be used "as is" as softener particles with or without detergent granules. They can be overcoated with a hard shell of ethyl cellulose, e.g., Ethocel Std. 4, (Dow Chemical Co., Midland, Mich. 48640). The amount of ethyl cellulose solids overcoated onto the particles is about 3% by weight of the total particle weight. The softener particles are sized through 12 on 30 Mesh U.S. Standard screens.

Detergent/Softener Composition

A granular detergent/softener composition is prepared by mixing 3 parts of the above ethyl cellulose overcoated softener particles with 97 parts of the following granular detergent composition.

| Ingredient | Wt. % |
|---|---|
| Sodium $C_{13}$ linear alkylbenzene sulfonate | 16.5 |
| Sodium $C_{14}$-$C_{15}$ linear fatty alcohol sulfate | 16.5 |
| Sodium sulfate | 23.8 |
| Sodium silicate | 9.2 |
| Polyethylene glycol | 0.9 |
| Polyacrylic acid | 1.3 |
| Sodium tripolyphosphate | 13.7 |
| Sodium carbonate | 4.8 |
| Methyl cellulose | 3.6 |
| Optical brightener | 1.3 |
| Protease enzyme | 1.6 |
| Moisture and miscellaneous | 6.8 |
| Total | 100.0 |

Bleach/Softener Composition

A granular bleach/softener composition is prepared by mixing 4 parts of either the above stearly alcohol coated softener particles or the above ethyl cellulose overcoated softener particles with 96 parts of the following granular bleach composition.

| Ingredient | Wt. % |
|---|---|
| Diperoxydodecanedioic acid | 24.0 |
| Dodecanedioic acid | 2.9 |
| Sodium $C_{13}$ linear alkylbenzene sulfonate | 5.5 |
| Boric acid | 27.7 |
| Sodium sulfate | 39.7 |
| Miscellaneous | 0.2 |
| Total | 100.0 |

The present invention will be further understood by the following nonlimiting examples.

EXAMPLE I

A granule containing methylcellulose soil release agent which dissolves rapidly under laundry wash cycle conditions is made according to the following procedure:

Methylcellulose powder (182 kg (400 lbs.) of Dow Methocel A-15LV Premium Grade) and polyethylene glycol (182 kg (400 lbs.) of Union Carbide Carbowax PEG 3350) are blended in a rotating drum mixer for 5 minutes. The blended material is then divided into four 200 L (55 gal.) fiber drums which are stored at 49° C. (120° F.) for 36 hours. The powder blend is then fed by hand into a radial extruder (Fuji Pandal Model EXDCS-100). The temperature of the material entering the extruder is ca 38° C. (100° F.). The resulting extrudate is recycled once through the extruder. After allowing the extrudate to cool to room temperature it is run through a Fitzmill, Model DA506, using a U.S. No. 14 mesh screen. The resultant material is sieved on a Rotex using a U.S. No. 48 mesh screen to remove fine particles.

EXAMPLE II

A nonwoven fabric is coated with soil release agent according to the following procedure:

450 ml of distilled water are added to a 2000 ml stainless steel beaker and heated to 70° C. (158° F.). 80 grams of Dow Chemical's Methocel A-15LV Premium Grade methylcellulose are slowly added to the water under good agitation conditions (a vortex was present). After the methylcellulose is well dispersed, the agitation is reduced to prevent aeration. 438 grams of 20° C. (68° F.) water are then added to the dispersion. Propylene glycol (32.0 g) is then added. The beaker is then placed in an ice bath and agitation continued until product became clear (an indication that the methylcellulose was dissolved). An 11.4 cm×28 cm (4.5 in.×11 in.) sheet of DuPont Reemay 2420 (a spunbonded, 63 g/m$^2$, 4 denier polyester fabric) was immersed in the methylcellulose solution. The saturated fabric was then run through an Atlas Electric Devices Co. laboratory wringer (Model LW-1) set at approximately 50 kg (110 lbs.) force. The wrung-out fabric is then line dried in a low humidity environment for 24 hours.The substrate is coated with about 0.75 g (0.028 oz.) of solid coating.

EXAMPLE III

A bleach granule having the composition detailed below is prepared using the procedure described in Example I of U.S. Pat. No. 4,374,035, supra, incorporated herein by reference.

| Ingredient | Wt. % |
|---|---|
| Diperoxydodecanedioic acid | 24.0 |
| Dodecanedioic acid | 2.9 |
| Sodium $C_{13}$ linear alkylbenzene sulfonate | 5.5 |
| Boric acid | 27.7 |
| Sodium sulfate | 39.7 |
| Miscellaneous | 0.2 |
| Total | 100.0 |

EXAMPLE IV

The following ganular detergent composition is prepared.

| | Base Granules | |
|---|---|---|
| | Weight % | Grams Final Composition Per Use |
| Sodium $C_{13}$ linear alkylbenzene sulfonate | 22.1 | 5.110 |
| Sodium $C_{14-15}$ alkyl sulfate | 22.1 | 5.110 |
| Sodium silicate (1.6 ratio) | 13.7 | 3.172 |
| Sodium sulfate | 32.2 | 7.455 |
| Polyethylene glycol (MW = 8000) | 1.5 | 0.340 |
| Sodium polyacrylate (MW = 4500) | 2.0 | 0.453 |
| $C_{12-13}$ alcohol polyethoxylate (6) | 3.0 | 0.680 |
| Sodium diethylenetriamine pentaacetate | 1.5 | 0.340 |
| Moisture | 2.0 | 0.462 |
| | | 23.122 |
| Preblend | | |
| Base granules | | 23.122 |
| Sodium tripolyphosphate hexahydrate (powdered) | | 20.576 |
| | | 43.698 |

-continued

| | Base Granules | |
|---|---|---|
| | Weight % | Grams Final Composition Per Use |
| Admix | | |
| Preblend | | 43.698 |
| Sodium tripolyphosphate (STP) hexahydrate (granular) | | 19.429 |
| Dye | | 0.003 |
| Brightener | | 0.613 |
| Suds suppressor prill comprising dimethysilicone, silica, sodium tripolyphosphate and polyethylene glycol (MW = 8000) | | 1.703 |
| Protease | | 2.044 |
| Sodium carbonate | | 4.000 |
| | | 71.490 |
| Spray-On | | |
| Admix | | 71.490 |
| Mineral oil | | 0.710 |
| | | 72.200 |

The base granules are produced by spray-drying an aqueous crutcher mix of the components on a ten foor tower using a crutcher temperature of 200° F., a size 3½ nozzle to make fine granules, and silicone deaeratants. If a second drying stage on a continuous fluid bed is used to reduce moisture to 2%.

The base granules are then admixed with powdered STP hexahydrate to form the preblend. The preblend is compacted at 50 psig roll pressure on a 4 in. by 10 in. chilsonator, and screened to select a −14(1168 microns)/+65(208 microns) particle size cut (Tyler mesh). Oversized particles are collected and granulated on a Fitzmill, Model DA506 (The Fitzpatrick Company, Elmhurst, Ill. 60126, using a 14 mesh screen and low rpm's. This is screened to select a −20(833 microns)/+48(295 microns) particle size cut. Both materials are dedusted by blowing off fines in a fluid bed dryer using ambient air.

The admix is prepared as a 400 pound batch in a drum mixer. Carbonate, granular STP (with dye sprayed-on), brightener, enzymes, and suds suppressor prills are blended with the compacted mainstream product cut and regranulated overs at a ratio of mainstream product cut to overs of about 7 to 1. Mineral oil is sprayed on the final admix in 30 to 40 pound batches at a 1% level using a Forberg Mixer.

EXAMPLE V

A preferred mode multipouched laundry cleaning article consistong of the soil release agent coated nonwoven substrate of Example II containing detergent (Ex. IV) and bleach granular (Ex. III) compositions is made using the following procedure. A 11.4 cm×28 cm (4.5 in.×11 in.) sheet of DuPont Reemay 2420 (a spunbonded, 63 g/m$^2$, 4 denier polyester fabric) is embossed or stretched to form a single roll of 6 cells similar to the pattern shown in FIGS. 7 and 8 of U.S. Pat. No. 4,571,924, A. S. Bahrani, issued Feb. 25, 1986, incorporated herein by reference. The six cups are embossed to a depth of approximately 1.0 cm (0.4 in.), and heat set. Each cup is approximately 3.6 cm. (1.4 in.) wide and approximately 9.8 cm. (3.8 in.) in length, each with about 30 cc capacity. Two cups are each filled with approximately 14 grams (0.50 ox.) of the granular bleach composition described in Example III. Each of the eight cups is filled with approximately 18 grams (0.64 oz.) of the granular detergent composition described in Example IV. A topsheet ply of the same dimensions and material as used for the embossed sheet is then attached to the filled, embossed ply by heat sealing with a sheet of polyethylene patterned to correspond to the rims of embossed ply. The nonwoven substrate is coated with methylcellulose soil release agent according to Example II such that the total level of methylcellulose in the article is about 1.1 g. The AvO to soil release agent ratio for this article is about 1:1.25 and the product delivers about 12 ppm AvO and 16 ppm of soil release agent in a 68 liter wash solution.

EXAMPLE VI

A multipouched laundry cleaning article is made according to Example V with the addition of 0.54 gram of the soil release agent granules described in Example I added to each of the four detergent pouches with a noncoated substrate. The total amount of soil release agent active is about 1.1 grams, thus the AvO to soil release agent ratio for this article is about 1:1.3.

What is claimed is:

1. A laundry composition comprising effective amounts of a peroxyacid bleach and a compatible soil release agent; wherein said composition provides overall cleaning performance on hydrophobic soils on synthetic fabrics beyond that possible with a comparable amount of either said peroxyacid or said soil release agent alone; and wherein said soil release agent is selected from the group consisting of:

A. alkyl and hydroxyalkyl ethers of cellulose containing from one to four carbon atoms in the alkyl moiety and having a molar degree of substitution of about 1.5 to about 2.7 and a number average molecular weight of about 2,000 to 100,000;

B. polymers comprising etylene terephthalate and polyethylene oxide terephthalate at mole ratio from about 1:10 to 10:1, said polyethylene oxide terephthalate containing polyethylene oxide units with a number average molecular weight from about 500 to about 10,000, and said soil release agent having a number average molecular weight of about 1,000 to 100,000:

C. polymers comprising propylene terephtalate and polyethylene oxide terephthalate at a mole ratio from about 1:10 to about 10:1, said polyethylene oxide terephthalate containing polyethylene oxide units with a number average molecular weight from about 500 to about 10,000, and said soil release agent having a number average molecular weight of about 1,000 to 100,000, or D. polymers comprising ethylene terephthalate and/or propylene terephthalate in any ratio and polyethylene oxide and/or polypropylene oxide in any ratio such that the mole ratio of ethylene terephthalate plus propylene terephthalate to polyethylene oxide plus polypropylene oxide is from about 1:10 to about 10:1, said polyethylene oxide units and said polypropylene oxide units each having a number average molecular weight from about 250 to about 10,000, and said soil release agent having a number average molecular weight of about 1,000 to about 100,000;

and mixtures thereof and wherein said peroxyacid bleach and said soil release agent are present such that the weight of available oxygen (AvO) of bleach to weight of soil release agent has a ratio of 2:1 to 1:2.

2. The composition of claim 1 wherein said peroxyacid bleach is selected from the group consisting of:

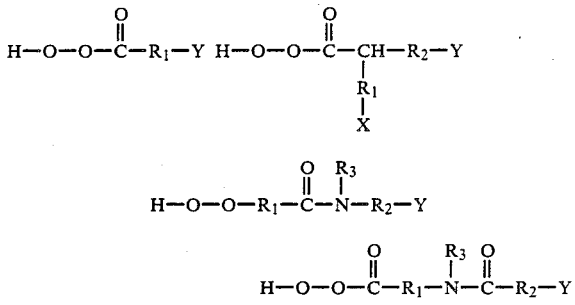

wherein $R_1$ and $R_2$ are alkylene groups containing from 1 to about 20 carbon atoms or phenylene groups, $R_3$ is hydrogen or an alkyl, aryl, or alkaryl group containing from about 1 to 10 carbon atoms, and X and Y are selected from the group consisting of: hydrogen, halogen, alkyl, aryl, or any group which provides an anionic moiety in aqueous solution.

3. The composition of claim 1 wherein said X and Y are selected from the group consisting of:

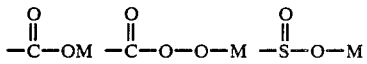

where M is hydrogen or a water-soluble salt-forming cation.

4. The composition of claim 1 wherein said soil release agent is a methylcellulose polymer and said peroxyacid bleach is diperoxydodecanedioic acid.

5. The composition of claim 1 wherein said composition is part of a through-the-wash article, and wherein said peroxyacid bleach and said soil release agent are enclosed in a pouch made from a water-permeable, but water-insoluble, substrate material.

6. A method comprising laundering fabrics in an aqueous solution containing effective amounts of peroxyacid bleach and soil release agent according to claim 1.

7. A laundry composition comprising an effective amount of a compatible soil release agent and an organic peroxyacid bleach precursor and a peroxygen bleaching compound capable of yielding hydrogen peroxide in an aqueous solution such that an effective amount of peroxyacid is thereby generated; wherein said composition provides overall cleaning performance on hydrophobic soils on synthetic fabrics beyond that possible with a comparable amount of either said peroxyacid or said soil release agent alone; and wherein said bleach and soil release agent have a ratio of 3:1 to 1:2 on an available oxygen weight basis and wherein said soil release agent is selected from the group consisting of:

A. alkyl and hydroxyalkyl ethers of cellulose containing from one to four carbon atoms in the alkyl moiety and having a molar degree of substitution of about 1.5 to about 2.7 and a number average molecular weight of about 2,000 to 100,000;

B. polymers comprising ethylene terephthalate and polyethylene oxide terephthalate at mole ratio from about 1:10 to 10:1, said polyethylene oxide terephthalate containing polyethylene oxide units with a number average molecular weight from about 500 to about 10,000, and said soil release agent having a number average molecular weight of about 1,000 to 100,000:

C. polymers comprising propylene terephtalate and polyethylene oxide terephthalate at a mole ratio from about 1:10 to about 10:1, said polyethylene oxide terephthalate containing polyethylene oxide units with a number average molecular weight from about 500 to about 10,000, and said soil release agent having a number average molecular weight of about 1,000 to 100,000, or D. polymers comprising ethylene terephthalate and/or propylene terephthalate in any ratio and polyethylene oxide and/or polypropylene oxide in any ratio such that the mole ratio of ethylene terephthalate plus propylene terephthalate to polyethylene oxide plus polypropylene oxide is from about 1:10 to about 10:1, said polyethylene oxide units and said polypropylene oxide units each having a number average molecular weight from about 250 to about 10,000, and said soil release agent having a number average molecular weight of about 1,000 to about 100,000;

and mixtures thereof.

8. The composition of claim 7 wherein the peroxyacid-generating composition comprises:

(a) a peroxygen bleaching compound capable of yielding hydrogen peroxide in an aqueous solution; and (b) a bleach activator having the general formula:

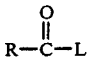

wherein R is an alkyl containing from about 5 to about 18 carbon atoms wherein the longest linear alkyl chain extending from and including the carbonyl carbon contains from about 6 to about 10 carbon atoms and L is a leaving group, the conjugate acid of which has a $pK_a$ in the range of from about 6 to about 13.

9. A method comprising laundering fabrics in an aqueous solution containing effective amounts of a soil release agent, an organic peroxyacid bleach precursor and an inorganic peroxygen salt according to claim 7 such that an effective amount of peroxyacid is generated when dissolved in an aqueous wash solution.

* * * * *

UNITED STATES PATENT AND TRADEMARK OFFICE

CERTIFICATE OF CORRECTION

PATENT NO. : 4,770,666

DATED : September 13, 1988

INVENTOR(S) : Allen D. Clauss

It is certified that error appears in the above-identified patent and that said Letters Patent is hereby corrected as shown below:

Col. 1, line 24, "terphthalate" should be -- terephthalate --.

Col. 3, line 50, the first "the" should be -- and --.

Col. 4, line 6, "hydrooxyalkyl" should be -- hydroxyalkyl --.

Col. 4, line 13, "polyethylen" should be -- polyethylene --.

Col. 4, line 31, "ay" should be -- any --.

Col. 4, line 55, after "release" insert -- agent component is released entirely or partially in: the wash --.

Col. 10, line 24, "foor" should be -- foot --.

Signed and Sealed this

Nineteenth Day of December, 1989

*Attest:*

JEFFREY M. SAMUELS

*Attesting Officer*

*Acting Commissioner of Patents and Trademarks*